US005203249A

United States Patent [19]

Adams et al.

[11] Patent Number: 5,203,249

[45] Date of Patent: Apr. 20, 1993

[54] MULTIPLE MANDREL/BRAIDING RING BRAIDER

[75] Inventors: Kenneth M. Adams, Sandy Hook; Richard J. Simkulak, Meriden, both of Conn.

[73] Assignee: United Technologies Corporation, Hartford, Conn.

[21] Appl. No.: 753,288

[22] Filed: Aug. 30, 1991

[51] Int. Cl.[5] ..... D04C 3/48

[52] U.S. Cl. ..... 87/34

[58] Field of Search ..... 87/1, 6, 11, 23, 29, 87/34; 242/7.09, 7.21, 7.22, 7.23

[56] References Cited

U.S. PATENT DOCUMENTS

| | | | |
|---|---|---|---|
| 2,675,733 | 4/1954 | Hemm et al. | 87/34 |
| 4,494,436 | 1/1985 | Kruesi | 87/23 |
| 4,519,290 | 5/1985 | Inman et al. | 87/7 |
| 4,753,150 | 6/1988 | Brown | 87/33 |
| 4,976,812 | 12/1990 | McConnell et al. | 156/148 |

FOREIGN PATENT DOCUMENTS

| | | | |
|---|---|---|---|
| 1430286 | 3/1976 | United Kingdom | 242/7.09 |

*Primary Examiner*—Joseph J. Hail, III

[57] ABSTRACT

A composite braiding apparatus has a rotatable cantilever mandrel support 20 that is capable of supporting multiple mandrels 17*a* and 17*b*. The mandrels can be properly oriented to be braided without removing them from the mandrel support 20. Once the braiding operation has begun on one mandrel 17, subsequent mandrels can be mounted on the mandrel support 20 while braiding is taking place. Then, when a braiding operation is completed, the other mandrel 17 can be moved into proper position for braiding. The invention also allows one mandrel 17*a* (or 17*b*) to be braided while the opposite mandrel 17*b* (or 17*a*) that is not being braided can be worked on manually without stopping the braiding operation. In accordance with another embodiment of the invention, a braiding apparatus 10' has two braid ring assemblies 11*a* and 11*b*. Both braiding rings 12*a* and 12*b* are mounted at opposite ends of a guide track 26. The inclusion of the second braiding ring 12*b* allows a second set of composite filaments 28 to be wound onto a mandrel 17*a* (or 17*b*) by a 180 degree rotation of the mandrel support 20, and possibly allows simultaneous braiding of two mandrels 17*a* and 17*b*.

7 Claims, 3 Drawing Sheets

MULTIPLE MANDREL/BRAIDING RING BRAIDER

TECHNICAL FIELD

This invention relates to a braiding apparatus and more particularly, to a head stock/mandrel assembly and braiding ring configuration for composite braiding.

BACKGROUND ART

Composite braiding is a filament placement operation wherein spools or cops wound with a composite filament material travel in a known manner circumferentially around a braiding ring (or braiding head) while depositing the material over a mandrel that moves axially relatively through the center of a braider guide ring which is positioned concentrically with the braiding ring. One half of the cops travel in a clockwise direction while the remaining half travel in a counterclockwise direction weaving alternately radially in and out of the first half. As the carriers move in a maypole-like fashion around the mandrel assembly, the mandrel moves axially through the center of the braider guide ring (or the braider guide ring moves axially back and forth over a fixed mandrel), thereby covering the mandrel with a braid of the composite filament.

The braiding machine was originally developed to produce many items that required continuous or repetitive braiding operations. Shoelace braiding is a typical example of such an operation wherein a continuous braid is formed and run until the cops or spools on which the filaments are wound are exhausted. Relatively few major changes have been made to the conventional braider since its inception, one of which was the changeover from vertical to horizontal braiding to facilitate braiding onto a mandrel. That change allowed a mandrel to be supported at opposite ends and reciprocated horizontally through the center of the braiding ring instead of vertically, thereby avoiding the cumbersome process of reciprocating a heavy mandrel vertically against the force of gravity. One such braider is depicted in FIG. 1, and a similar braider is disclosed in U.S. Pat. No. 4,519,290.

Although the change to horizontal braiding facilitated the manufacture of composite structures, composite braiding is still relatively cumbersome. Using a conventional braiding machine to braid composite materials over mandrels is time-consuming and relatively inefficient, and can make products fabricated with new high-technology composite materials undesirably expensive. A major element of the efficiency problem is the high ratio of braider set-up time to braider run time. That ratio and corresponding inefficiencies are high because a relatively long time is needed to fit the braider with replenished cops after each relatively short braiding run.

This set-up time problem is particularly acute in the manufacture of components for the aerospace field, where the braiding process must be stopped, the filaments cut, and all the cops replaced, before any of the cops run out of composite filament. This requirement exists to ensure that the full complement of filaments extends through the entire article, thus ensuring that the finished article meets strict strength specifications.

Where low weight is not critical, articles may be engineered with significantly higher factors of safety than is typical in aerospace applications. A higher safety factor in turn allows many non-aerospace articles to maintain adequate strength with less than the full complement of filaments. The safety factor designed into most non-aerospace articles thereby allows the braiding operation to continue after some of the cops have run out of filament and thus permits substantially all of the cops to be emptied.

The importance of maintaining a full complement of filaments is greater in the aerospace industry than in many non-aerospace applications because low article weight is a primary design requirement. Typically, low article weight is accompanied with tight factors of safety thus necessitating a requirement of high fiber fidelity to maintain adequate article safety margins.

Since low article weight is a priority, the aerospace industry does not typically enjoy the benefits associated with producing articles that have been designed with large safety factors. As a result, a full complement of filaments must be maintained, and to ensure that this result is attained, the braiding operation must be terminated while all the cops still have some unused filaments wound on them. Thus, when aerospace components are being fabricated, the problem of the high ratio of braider set-up time to braider run time is further aggravated since the amount of braided product that can be produced from each set of wound cops is substantially reduced.

After the cops are depleted, replacement of the cops on a large (144 carrier) braider can take from one and one-half to two hours. This process can be substantially longer than a braiding run which may typically be as short as 30 minutes. Thus, for every braiding run, three to four times the run time may be needed for set-up, resulting in inefficiencies which contribute to the costs of manufacturing composite products. These costs can make composite products less competitive in the marketplace than products fabricated from conventional materials.

Another problem with braiding composite products is that often, independent manual operations serving to further reinforce the article are required during the braiding process. Such operations frequently require that the braiding process be stopped and the mandrel withdrawn from the braiding ring after a layer of composite filaments has been applied. The manual operation is then performed on the mandrel while the braiding machine is idle. As a result, braider efficiency is again reduced due to down-time while manual operations are performed, thus contributing to the manufacturing costs associated with composite products.

A further problem which adds to the expense and inefficiency associated with composite braiding arises when it is desired to have two different sets of composite filaments braided over the mandrel. Many composite articles are composed of stacked layers of different material to achieve desired strength characteristics. Typical applications consist of alternate layers of carbon fiber filaments and glass filaments, or alternate layers of carbon fiber filaments and filaments of a material sold under the trademark Kevlar ®. To effect this resultant layering, it is common practice to intermittently replace all the cops of one material with cops loaded with another material. Each changeover adds an additional one and one-half to two hours to the initial set-up time, further decreasing braider efficiency.

DISCLOSURE OF THE INVENTION

An object of this invention is to reduce braider downtime and thereby increase efficiency by allowing the braider to apply braid on a mandrel concurrently with preparing another mandrel on the braider to receive braid.

An additional object of the present invention is to facilitate the winding of two different sets of filament materials without requiring either the removal of a first set of filaments from a braiding ring, or the removal of the mandrel from the braider headstock, to increase braider efficiency.

According to the invention, a composite braiding apparatus has a rotatable cantilever support structure which is disposed and structured to secure a plurality of mandrels to a headstock to permit mandrel installation and the execution of manual operations on one or more mandrels concurrently with braid being wound on another mandrel. A further embodiment of the invention permits a mandrel to be rotated to align with a second braiding ring for depositing a second set of composite filaments.

The invention has the further benefit of possibly reducing the number of operators needed to perform the steps associated with manufacturing composite items, thus contributing to efficient composite production.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
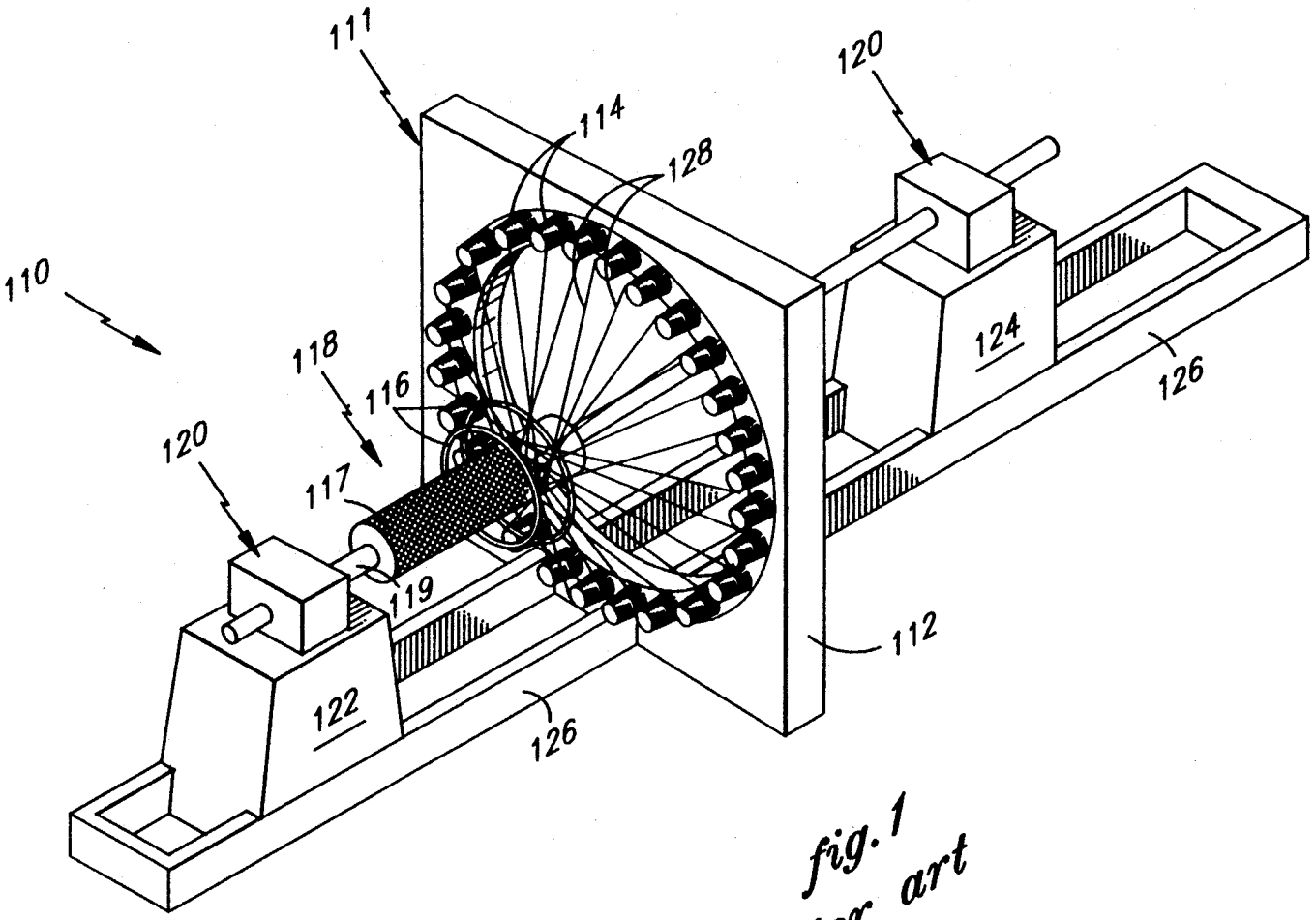
fig. 1 prior art
FIG. 1 is a perspective view of a conventional composite braiding apparatus.

In FIG. 1 a prior composite braiding apparatus 110 includes a braid ring assembly 111 which in turn includes a braiding ring 112, cops or spools 114, and braider guide rings 116. The braiding apparatus 110 also includes a mandrel 117 and a mandrel support assembly 118, the mandrel support assembly including a mandrel spindle 119, a pair of mandrel supports 120 positioned on opposite sides of the braiding ring 112, a tailstock support 122 positioned on the same side of the braiding ring 112 as the guide rings 116 and which supports one of the mandrel supports 120, and a powered headstock 124 positioned on the opposite side of the braiding ring 112 from the tailstock support 122 and which supports the other mandrel support 120. The braiding apparatus 110 further includes a guide track 126 which guides tailstock and headstock supports 122 and 124 respectively. The powered headstock 124 reciprocates the mandrel 117 axially through the braider guide rings 116 while the unpowered tailstock 122 follows the axial motion of the headstock 124 in track 126. The braider guide rings 116 are concentric with, but offset from, the main braiding ring 112 thereby forming a conical array of composite filaments 128. Such orientation is necessary to allow the filaments 128 to cross over one another during the braiding operation, while additionally determining fiber angle orientation of the composite article produced.

Figure 2:
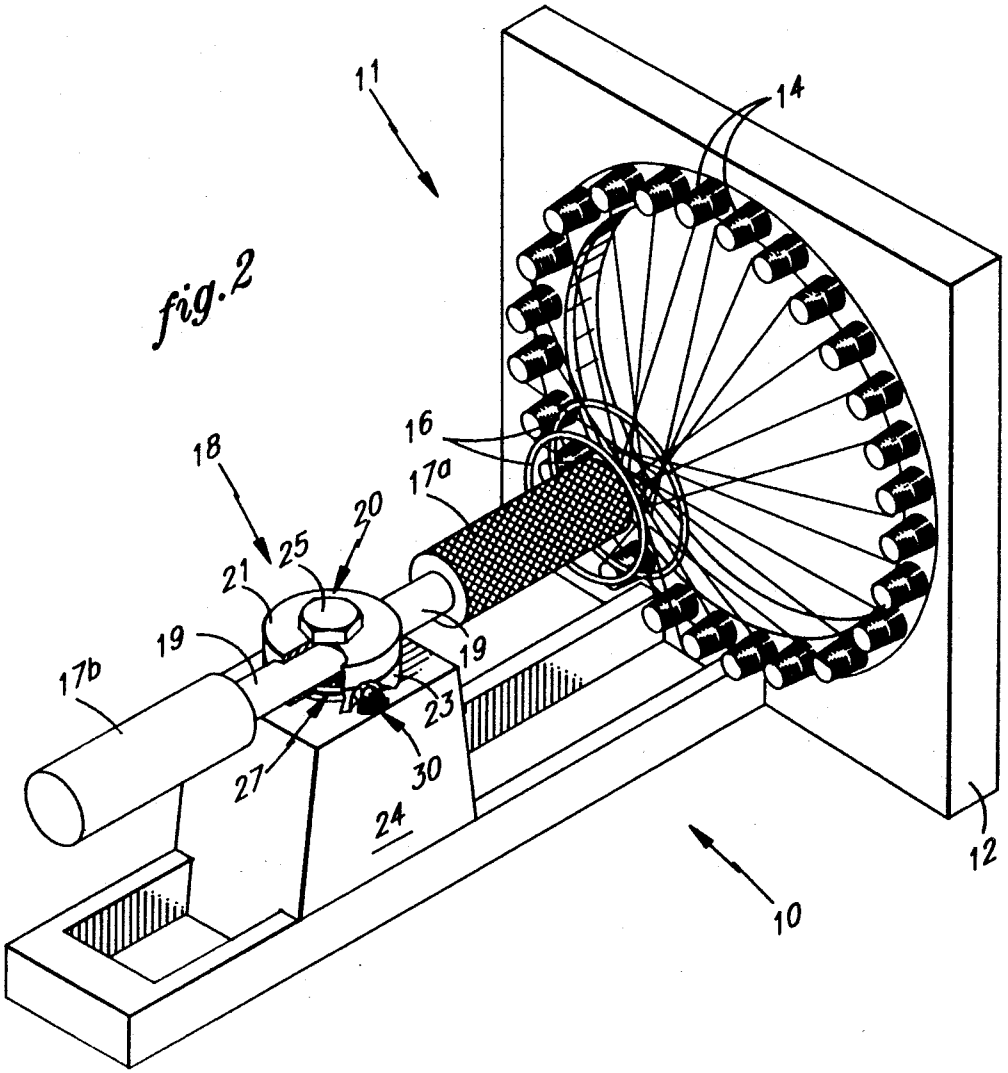
FIG. 2 is a perspective view of a composite braiding apparatus including a braiding ring as depicted in FIG. 1 and further including a partially cut-away rotatable mandrel support in accordance with the invention.

Referring to FIG. 2, braiding apparatus 10 of the present invention is in most respects similar or identical to braiding apparatus 110. A mandrel support assembly 18 includes a rotating cantilever mandrel support 20 which has opposing upper and lower clamp portions 21 and 23 respectively, a center bolt 25, a conventional thrust bearing 27, a positioning detent 30, and a mandrel spindle 19 which is supported at the midpoint of its length by mandrel support 20.

The mandrel support assembly 18 rotates on the thrust bearing 27 which is positioned between the lower clamp portion 23 and the headstock support 24. The positioning detent 30, depicted herein as a conventional ball-lock, snaps into place and stops the rotation once the mandrel 17*a* (or 17*b*) is facing directly into the center of the braiding ring and is thus in proper position for braiding to commence. This positioning detent 30 is located between the lower clamp portion 23 and the headstock support 24.

The opposing upper and lower clamp portions 21 and 23 respectively of the mandrel support 20 each have semi-cylindrical recesses in their mutually facing surfaces which are opposite one another and which allow the mandrel spindle 19 to be gripped between them. The clamp portions 21 and 23 grip the mandrel spindle 19 at the midpoint of the spindle's length, and the spindle 19 is held securely by clamping bolts (not shown) which pass through clamp portion 21 and are threaded into clamp portion 23 in a conventional manner and which serve to clamp the spindle 19 between the portions 21 and 23. The mandrel support 20 is fastened in a conventional manner to the powered head stalk 24 with a center bolt 25 that is located in the center or pivot point of mandrel support 20 and which passes respectively through openings in the upper clamp portion 21, mandrel spindle 19, lower clamp portion 23, and through the center of thrust bearing 27 before being threaded into the headstock 24. The mandrel support assembly 18 is positioned on the same side of the braiding ring 12 as the braider guide rings 16.

The rotating cantilever mandrel support 20 is capable of supporting multiple mandrels, and is depicted in FIG. 2 supporting two mandrels 17*a* and 17*b*, one on either end of mandrel spindle 19. Either mandrel 17*a* or 17*b* can be properly oriented to be braided without removing either of them from the mandrel support 20. By loosening the center bolt 25, the mandrel support 20 can be rotated until the positioning detent 30 engages and thus indicates that either one of the mandrels 17*a* or 17*b* is in proper braiding position. The center bolt 25 can then be tightened to secure the mandrels for braiding. As depicted, mandrel 17*a* is receiving braid, and mandrel 17*b* has not yet been rotated into position to receive braid.

Thus, the positioning detent 30, in conjunction with center bolt 25, thrust bearing 27, and clamp portions 21 and 23 respectively, provide means for adapting the mandrel support assembly 18 to rotatably mount a plurality of angularly spaced mandrels 17*a* and 17*b* for selectively rotating each of the mandrels toward the braid ring assembly 11 for braiding.

Since the reciprocations of the mandrel support 20 are relatively slow (between 15 and 30 inches per minute), once the braiding operation has begun on one mandrel 17, subsequent mandrels can be mounted on the free end of spindle 19 while braiding is taking place. Then, when a braiding operation is completed, the filaments can simply be cut, the support 20 rotated, and the other mandrel 17 moved into proper position for braiding. In this arrangement, efficiency is improved because braiding operations can continue almost without interruption, without having to suspend braiding operations while a new mandrel 17 is mounted to the support 20.

Furthermore, since the manufacture of many composite structures requires that layers of composite braid be alternated with manually applied reinforcement, the arrangement of the invention allows one mandrel 17*a* (or 17*b*) to be braided while the opposite mandrel 17*b* (or 17*a*) that is not being braided can be worked on manually, thus improving the efficiency of the braider apparatus 10 by eliminating the downtime associated with stopping the braiding operation while the manual reinforcement operations are performed.

Figure 2A:
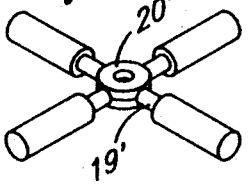
FIG. 2A is a perspective view of a four mandrel configuration for use with the rotatable mandrel support of FIG. 2.

In FIG. 2A, an alternate embodiment of a rotatable mandrel support 20′ mounts a mandrel spindle 19′ that is cruciform in geometry and allows four mandrels (17*a*, 17*b*, 17*c*, and 17*d*) to be secured to it. This configuration further increases braider efficiency.

As a result of the configurations of the invention as illustrated in FIGS. 2 and 2A, braider efficiency is substantially improved. These efficiency improvements are realized both by allowing mandrels to be installed, and by allowing manual reinforcement operations to be performed, while braiding is taking place.

Figure 3:
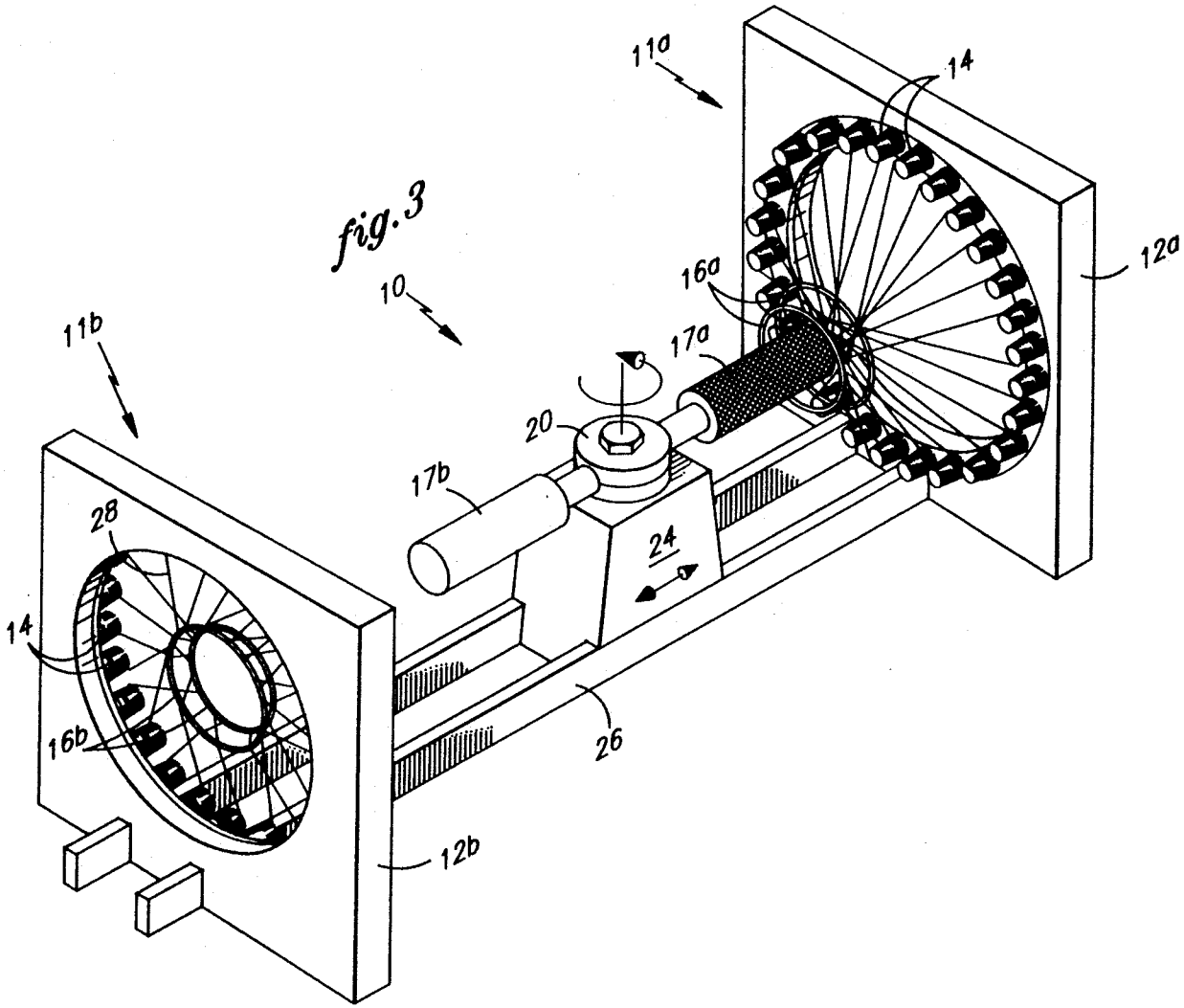
FIG. 3 is a perspective view of a further embodiment of the invention, depicting a composite braider with the rotatable mandrel support of FIG. 2 and including a second braiding ring.

In FIG. 3, in accordance with another embodiment of the invention depicted in FIGS. 2 and 2A, a braiding apparatus 10, has two braid ring assemblies 11*a* and 11*b*. The braider guide rings 16*a* of a first braiding ring 12*a* face the braider guide rings 16*b* of the second braiding ring 12*b*, and both braiding rings 12*a* and 12*b* are mounted at opposite ends of a guide track 26. The inclusion of the second braiding ring 12*b* allows a second set of composite filaments 28 to be wound onto a mandrel 17*a* or 17*b* which is in turn supported by a rotatable mandrel support 20. As depicted, mandrel 17*a* is receiving braid, and mandrel 17*b* has not yet received braid. The braiding apparatus 10′ equipped with the second braid ring assembly 11*b* affords multiple opportunities for increased efficiency.

One opportunity for increased efficiency arises when a composite article is being braided with stacked layers of alternating sets of composite filaments 28. Alternate sets of filaments are layered to enable the article to meet specific or enhanced structural requirements. A typical example of such alternate layers might include layers of braided glass filaments alternated with layers of braided carbon fiber filaments. Conventionally, such layering is accomplished with a prior single ring/single mandrel braider by braiding a layer of the first set of filaments 28 onto the mandrel 17, then removing the cops 14 from the braiding ring 12, and replacing them with cops 14 wound with the second set of filaments 28. This set-up of alternate cops 14 onto the ring 12 typically takes one and one-half hours or more. Once the second layer is braided, the alternate cops 14 must then be removed and the original cops re-installed to complete the third layer, requiring further set-up time of one and one-half hours. Conventional braiding thus requires an additional one and one-half hours or more for each alternating layer of filaments.

However, with the second braiding ring 12*b* of the invention equipped with cops 14 loaded with the second filament 28, the mandrel support 20 can simply be rotated 180 degrees to position the mandrel 17*a* for its subsequent layer of braid. Since many layers may typically be braided onto an average size mandrel 17*a* before the cops run out of filament 28, from two or four or more set-ups at nominally one and one-half hours each may be eliminated, saving a total of three to six hours or more per braiding run. Hence, by incorporating dual braid ring assemblies 11*a* and 11*b* with a rotating mandrel support 20, repetitive operations are performed with little interruption, thereby dramatically enhancing braider efficiency.

Furthermore, it may be possible to move the braid ring assemblies 11*a* and 11*b* so that they are the proper distance from one another to allow two mandrels 17*a* and 17*b* to be braided simultaneously. This could greatly improve braider efficiency since two mandrels could be braided during each braiding run instead of only one.

Still another opportunity for increased efficiency relating to the use of a second braid ring assembly 11*b* arises when braiding a single set of filaments onto a mandrel. An increase in efficiency is realized since the second braiding ring 12*b* can be set up with cops 14 of the required set of composite filaments 28 while the mandrel 17*a* is being braided by the first ring 12*a*. Thus when the supply of filament 28 on cops 14 of the first ring 12*a* is exhausted, the mandrel support 20 can be rotated to position the mandrel 17*a* so as to be braided by the second ring 12*b* without having to wait for the first ring 12*a* to be set up with new cops 14. Although the time necessary for a typical set up of the braiding ring 12 (nominally one and one-half hours) may be longer than the time necessary for a typical braiding operation to run the filaments 28 out of the cops 14 (nominally one-half), an increase in efficiency is generated by a reduction of approximately one-half hour or more of braider downtime. This downtime reduction is equivalent to the portion of the set-up of the second ring 12*b* that occurs while the mandrel 17*a* is being braided by the first ring 12*a*.

Although the arrangement of the best mode shows rotatable headstocks in two and 4 mandrel configurations, it should be understood that any number of mandrels may be secured in such a way as to allow each mandrel to be rotated into position for braiding, and still remain within the scope of this invention.

It should also be understood that a rotatable mandrel support assembly may be utilized in conjunction with a reciprocating mandrel, a reciprocating braiding ring, or reciprocating braiding rings, or some combination of the above, to provide movement of the mandrel relative to the ring, and still remain within the scope of the invention.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

What is claimed is:

1. A composite braiding apparatus for depositing composite filaments on a mandrel comprising:

a braid ring assembly equipped with a braiding ring, a braider guide ring, and a plurality of cops wound with composite filaments, for depositing a plurality of said composite filaments on a mandrel;

a mandrel support assembly for holding said a mandrel in position to receive braided filaments; and means for effecting reciprocation of said mandrel support relative to said braid ring assembly, characterized by:

said mandrel support assembly including means for mounting a plurality of mandrels in angularly spaced relation to one another and means for rotating and selectively orienting each of said mandrels toward said braid ring assembly for braiding; and an other said braid ring assembly, the two of said braid ring assemblies being spaced from one another and including said mandrel support assembly positioned therebetween, said braider guide ring of one of said braid ring assemblies facing a braider guide ring of the other of said braid ring assemblies for allowing said mandrel to be rotated to align with either of said braid ring assemblies for depositing said composite filaments.

2. The composite braiding apparatus of claim 1 wherein each of said braid ring assemblies is loaded with a different set of composite filaments than the other to allow said mandrel to be rotated to align with either braid ring assembly for depositing said different composite filaments.

3. The composite braiding apparatus of claim 1 further characterized in that said mandrel support assembly comprises:

a mandrel spindle having multiple ends for supporting a respective mandrel at each said end;

a mandrel support for supporting said mandrel spindle; and a headstock support for mounting said mandrel support, said mandrel support mounting said mandrel spindle in a cantilever manner at substantially a midpoint of said spindle's length and width, at least one of said mandrel support and said headstock support being rotatable to selectively position each of said spindles toward said braid ring assembly for braiding on the respective mandrel.

4. The composite braiding apparatus of claim 3 wherein said mandrel support assembly is further characterized by:

said mandrel spindle being cruciform in shape.

5. The composite braiding apparatus of claim 3 wherein said mandrel support is further characterized by:

an upper clamp portion and a lower clamp portion, said clamp portions having opposed surfaces, each opposed surface having a recess that matches the contours of the upper half and the lower half respectively of said mandrel spindle, said upper and lower clamp portions being displaceable relative to one another into and out of clamping engagement with said mandrel spindle, and means for maintaining said upper and lower clamp portions in engagement with said mandrel spindle to thereby clamp said mandrel spindle therebetween.

6. The composite braiding apparatus of claim 3 wherein said mandrel support is further characterized by:

a bolt for mounting said mandrel support to said headstock support, said bolt passing through the center of said mandrel support for selective loosening to facilitate rotation of said mandrel, and for subsequent tightening to secure said mandrel for braiding.

7. The composite braiding apparatus for depositing composite filaments on a mandrel comprising:

a braid ring assembly equipped with a braiding ring, a braider guide ring, and a plurality of cops wound with composite filaments, for depositing a plurality of said composite filaments on a mandrel;

a mandrel support assembly for holding said a mandrel in position to receive braided filaments; and means for effecting reciprocation of said mandrel support relative to said braid ring assembly, characterized by:

a mandrel spindle having multiple ends for supporting a respective mandrel at each said end;

a mandrel support for supporting said mandrel spindle; and a headstock support for mounting said mandrel support, said mandrel support mounting said mandrel spindle in a cantilever manner at substantially a midpoint of said spindle's length and width, at least one of said mandrel support and said headstock support being rotatable selectively position each of said spindles toward said braid ring assembly for braiding on the respective mandrel, and said mandrel support further comprising an upper clamp portion and a lower clamp portion, said clamp portions having opposed surfaces, each opposed surface having a recess that matches the contours of the upper half and the lower half respectively of said mandrel spindle, said upper and lower clamp portions being displaceable relative to one another into and out of clamping engagement with said mandrel spindle, and means for biasing said upper and lower clamp portions in engagement with said mandrel spindle to thereby clamp said mandrel spindle therebetween.

* * * * *